US007607500B2

(12) United States Patent
Sweringen et al.

(10) Patent No.: US 7,607,500 B2
(45) Date of Patent: Oct. 27, 2009

(54) INTERNALLY ELECTRICALLY POWERED BUMPER CARS COMPRISING MULTIPLE DRIVE WHEELS AND INTEGRAL HUB MOTORS

(76) Inventors: Michael L. Sweringen, 128 Phoenix Ave. SE., Salem, OR (US) 97306; John J. Dean, 346 Mansfield St., Eugene, OR (US) 97477; Henry Gorgas, P.O. Box 40, Carlton, OR (US) 97111

( * ) Notice: Subject to any disclaimer, the term of this patent is extended or adjusted under 35 U.S.C. 154(b) by 468 days.

(21) Appl. No.: 11/372,398

(22) Filed: Mar. 8, 2006

(65) Prior Publication Data

US 2007/0209851 A1 Sep. 13, 2007

(51) Int. Cl.
*B60K 1/00* (2006.01)

(52) U.S. Cl. ..... 180/65.51; 180/65.1; 318/432; 318/139; 388/903

(58) Field of Classification Search ..... 180/65.5; 320/121, 122; 388/903; 318/563, 430–434, 318/139

See application file for complete search history.

(56) References Cited

U.S. PATENT DOCUMENTS

| | | | | |
|---|---|---|---|---|
| 4,237,990 | A | 12/1980 | La | |
| 4,324,301 | A | 4/1982 | Eyerly | |
| 4,484,646 | A | 11/1984 | Smith | |
| 4,522,390 | A | 6/1985 | Kudler | |
| 4,715,460 | A | 12/1987 | Smith | |
| 5,251,910 | A | 10/1993 | Lamanna | |
| 5,484,030 | A | 1/1996 | Glenn | |
| 5,516,169 | A | 5/1996 | Falk et al. | |
| 5,577,736 | A | 11/1996 | Arabo | |
| 5,796,192 | A | 8/1998 | Riepl | |
| 5,997,017 | A | 12/1999 | Tilley | |
| 6,019,682 | A | 2/2000 | Arabo | |
| 6,095,268 | A * | 8/2000 | Jones, Jr. | 180/6.5 |
| 6,581,350 | B2 | 6/2003 | Dean | |
| 6,907,949 | B1 | 6/2005 | Wang | |

OTHER PUBLICATIONS

Courtney Electronics, Inc., Dual30 Quick Start Guide.*

(Continued)

*Primary Examiner*—Christopher P Ellis
*Assistant Examiner*—Bryan A Evans
(74) *Attorney, Agent, or Firm*—Klarquist Sparkman, LLP

(57) ABSTRACT

"Bumper car" amusement rides are disclosed. An exemplary bumper car comprises a frame, a seat, a portable source of electrical power for propelling the car, multiple drive wheels, a motor controller, and at least one rider control. The seat is configured to hold and position at least one rider of the bumper car. The source is a portable source, mounted to the frame, of electrical power for propelling the bumper car. Each drive wheel comprises a respective hub motor that, when supplied with the electrical power from the source, rotates the respective drive wheel relative to the frame and propels the bumper car. The controller is connected to the source and to the hub motors. The controller is configured: (a) to limit a maximal current supplied by the source to the hub motors during a surge-current situation to a preset maximum, and (b) to ramp down the maximal current over a preset time interval during the surge-current situation. The at least one rider control is interconnected with the source and the hub motors and is configured to be manipulated by a rider for maneuvering the bumper car.

29 Claims, 8 Drawing Sheets

OTHER PUBLICATIONS

Courtney Electronics, Inc., Dual30 Wiring Diagram.*
Perko, Inc., Battery Switches Installation and Operating Instructions, Mar. 4, 2005, www.foreandaftmarine.com.*
Anonymous, "A Nonconformist Dodgem Car," *Games and Parks Industry*, Apr. 2003, pp. 70-71.
Anonymous, "bump 'em, dodg'em, you just gotta . . . ride 'em," *Park World*, 4 pages.
Anonymous, "Pull Up to the Bumper," Apr. 2003, pp. 16-19.
Anonymous, "Classic Cars," *Park Products*, Apr. 2005, 4 pages.
Courtney Electronics, Inc., "Dual30 Quick Start Guide," *OSG_Quad10P*, pp. 1-5.
Courtney Electronics, Inc., "Dual30 Module Download Program," *OSG_Quad10P*, pp. 1-2.
Courtney Electronics, Inc., "Dual30 Wiring Diagram," 1 page.
Ride Development Company, "RDC® Bumper Cars," *company product brochure*.

* cited by examiner

LEGEND

Throttle Zone

Neutral Zone

| | |
|---|---|
| FFV | Forward Full-On Voltage |
| FOV | Forward Off Voltage |
| ROV | Reverse Off Voltage |
| RFV | Reverse Full-On Voltage |
| LF | Left Full-On Voltage |
| LO | Left Off Voltage |
| RO | Right Off Voltage |
| RF | Right Full-On Voltage |

INTERNALLY ELECTRICALLY POWERED BUMPER CARS COMPRISING MULTIPLE DRIVE WHEELS AND INTEGRAL HUB MOTORS

FIELD

This disclosure pertains to amusement rides, especially of a type known as "bumper cars." More specifically, the disclosure pertains to, inter alia, electrically powered bumper cars each carrying its own source of electrical power. Such electrically powered bumper cars are termed herein "internally electrically powered."

BACKGROUND

Amusement rides known as "bumper cars" have been known and enjoyed for many years. (For example, certain models in the past were known as "Dodgem Cars" and "Glidabouts.") A modern bumper car is a self-propelled, steerable vehicle usually intended to carry one or two riders around in an arena or the like without having to confine the vehicles to a track. The vehicles are individually equipped with compliant but resilient shock-absorbing structures ("bumpers"), mounted usually around the periphery of the vehicle, that allow the bumper cars to engage in collisions and the like without injury to the riders or damage to the cars, and without tipping the cars over. An exemplary type of bumper is disclosed in U.S. Pat. No. 5,516,169 to Falk et al., incorporated herein by reference. Whereas most types of conventional bumper cars are electrically powered, some are powered by small gasoline engines.

Most conventional electrically powered bumper cars are "externally" powered, i.e., powered by electrical current supplied to the bumper cars from a stationary source such an electrified floor or electrified floor and ceiling. An exemplary electrified floor is disclosed in U.S. Pat. No. 6,581,350 to Dean, incorporated herein by reference. In the '350 patent, direct-current electrical power is conducted from the floor to the cars via electrical pickups ("shoes" or "brushes") beneath the cars that remain in sliding contact with the floor as the cars are being driven around on the floor.

One type of conventional externally powered bumper car comprises a frame to which are mounted the bumpers and a body including a seat for the rider. Also mounted to the frame, below the level of the seat, are driving wheels and stabilizing wheels (e.g., caster wheels). The driving wheels move the bumper car around the floor while the stabilizing wheels stabilize the car relative to the floor. Also mounted to the frame is a DC electric motor that runs continuously while the bumper car is being driven. Power from the motor is selectively delivered to the driving wheels via respective hydrostatic transmissions. The respective amounts of driving power delivered by the transmissions to the wheels are individually controlled by mechanisms, such as respective control levers, that are coupled to the transmissions, mounted to the frame, and manipulated by the rider. The rider steers the car by selectively applying, via the control levers gripped by the rider's hands, driving power to each driving wheel. In this type of bumper car, the manner in which driving power produced by the motor is delivered to the driving wheels is mechanically inefficient. The inefficiency is masked because the bumper car can draw as much current as it ever needs from the conductive floor. But, on the other hand, the bumper car can only be operated on a conductive floor, which imposes limitations and additional costs on use of the bumper car.

Another type of conventional bumper car is similar to the type summarized above, except that the electric motor is replaced with a gasoline motor. Use of a gasoline motor allows the bumper car to be operated on a non-electrified surface, but the mechanical inefficiencies are still present.

Other conventional bumper cars are configured for operation on a non-electrified surface by supplying electrical current from a battery mounted on and carried by the car. Unfortunately, to date, battery power for bumper cars has been disappointing for any of several reasons, as summarized below.

One conventional type of battery-powered bumper car utilizes a DC motor coupled via a gear box and chain-drive to a drive wheel. Steering is achieved by turning, via a first control, the entire mechanism of motor, gear box, and drive wheel. Motion and braking of the bumper car is achieved by manipulating a second control that turns the motor on and off. As noted above, normal use of a bumper car is characterized by a large number of rapidly executed starts, stops, directional maneuvers, and "bumps" into other bumper cars and walls. Driving the bumper car into a stationary wall or into another car can cause an abrupt stall (halt in rotation) of the motor even though power is still being delivered to the motor. At the moment of a stall, the motional emf of the motor drops to substantially zero, which causes the motor to draw a very large current (surge current) that is limited only by the inductance and resistance of the motor windings. Draw of surge current also occurs during starts of the bumper car from a stopped position and during rapid transitions from forward to reverse and vice versa. The large number of such draws of surge current accompanying normal use of the bumper car causes rapid battery drain (and if prolonged can cause overheating and failure of the motor). Consequently, the bumper car must be taken out of service frequently for recharging of the battery. Also, the manner of coupling the motor to the drive wheel is mechanically inefficient, and the steering mechanism in this type of bumper car is incapable of executing 360° spins "on a dime," as currently desired in bumper-car rides.

Another type of conventional battery-powered bumper car comprises a small DC motor to which are coupled two gear boxes. Each gear box drives a respective drive wheel via a respective drive belt or chain. Forward, reverse, and steering motions of the car are achieved by manipulation of controls coupled to the gear boxes. In the course of driving the bumper car in rapid start, stop, and reverse maneuvers, surge current being delivered to the motor is reduced by use of hydraulic motion limiters in the controls. The motion limiters impose limits on the rate at which the rider can change motion of the car (e.g., impose a time delay in shifting from forward to reverse). This mechanism is complicated and inherently reduces the responsiveness of the car. Hence, this mechanism is used mainly on small, low-mass bumper cars intended to be ridden by very light-weight riders (namely, small children). Loads imposed by larger and heavier riders result in unacceptable rates of battery drain and render the bumper cars too unresponsive for acceptance by older children and adult riders.

Therefore, there is a need for bumper cars that are internally electrically powered while exhibiting an acceptable operational life of the portable source of electrical power carried by each car, without causing any significant detriment to the maneuverability and other performance features that riders expect from such amusement rides.

SUMMARY

The need articulated above is satisfied by any of various "internally electrically powered" bumper cars as disclosed herein. The term "internally" used in this context simply denotes that the car carries its own electrical power rather than obtaining power from an external source such as a conductive floor. "Internally" does not necessarily mean that the power source is hidden or otherwise internal with respect to a housing or the like. An embodiment of such a bumper car comprises a frame, a seat, a portable source of electrical power, multiple drive wheels, a motor controller, and at least one rider control. The seat is attached to the frame and configured to hold and position at least one rider of the bumper car. The portable electrical source is mounted to the frame and provides electrical power for propelling the bumper car. The multiple drive wheels are mounted to the frame. Each drive wheel comprises a respective hub motor that, when supplied with electrical power from the source, rotates the respective drive wheel relative to the frame and thus propels the bumper car. The motor controller is connected to the source and to the hub motors. The motor controller is configured to perform at least the following: (a) limit a maximal current, supplied by the source to the hub motors during a surge-current situation, to a preset maximum, and (b) ramp down the maximal current, over a preset time interval, during the surge-current situation. The at least one rider control is interconnected with the source, the hub motors, and the motor controller. The at least one rider control is configured to be manipulated by a rider for propelling and maneuvering the bumper car.

The motor controller desirably is further configured to limit a steady-state current, supplied to the hub motors during actual running of the motors, to a preset value that is lower than the maximal current.

Alternatively, the motor controller is configured to perform at least two of the following: (a) limit a maximal current, supplied by the source to the hub motors during a surge-current situation, to a preset maximum, (b) ramp down the maximal current, over a preset time interval, during the surge-current situation, and (c) limit a steady-state current, supplied to the hub motors during actual running of the motors, to a preset value that is lower than the maximal current.

The bumper car desirably further comprises a bumper mounted to and extending substantially circumferentially around the frame, for cushioning impacts of the bumper car with other objects.

The source of electrical power desirably comprises at least one battery, most desirably multiple batteries. The multiple batteries desirably are arranged in pairs, wherein each pair is connected so as to provide, in a selectable individual manner, electrical power to the hub motors. Thus, when one pair is supplying the electrical power to the hub motors, the other pair can be off-line (not supplying electrical power to the hub motors), and vice versa. By way of example, the source of electrical power can comprise a first battery set and a second battery set, wherein the sets are connected so as to provide, in a selectable individual manner, electrical power to the hub motors, such that, when the first battery set is supplying the electrical power to the hub motors, the second battery set is off-line, and vice versa. In one embodiment the first battery set comprises two respective batteries, and the second battery set comprises two respective batteries. In each battery set, the respective batteries desirably are connected together in series.

Bumper cars comprising multiple, selectably usable battery sets desirably further comprise a battery-selector switch interconnected with the battery sets. In one embodiment the battery-selector switch has a first selectable position allowing electrical power to be drawn from the first battery set to the hub motors, and a second selectable position allowing electrical power to be drawn from the second battery set to the hub motors.

The rider control can have any of various configurations such as joysticks, dual potentiometer controls, or other suitable configuration. In one embodiment two joysticks are used. In this embodiment the multiple drive wheels comprise a left drive wheel and a right drive wheel. A first joystick is connected so as to control operation of the left drive wheel, and a second joystick is connected so as to control operation of the right drive wheel. The first joystick desirably is situated to be manipulated by the left hand of the rider, and the second joystick desirably is situated to be manipulated by the right hand of the rider, independently of the first joystick.

By way of example, a bumper car embodiment comprises an internal power source that produces 24 VDC. In this embodiment the respective hub motors are configured to run on the 24 VDC for rotating the respective drive wheels. Further by way of example in this 24 VDC-powered embodiment, the motor controller is configured: (a) to limit the maximal current supplied to the hub motors during a surge-current situation to a preset maximum in the range of 25 to 30 amps, (b) to limit the steady-state current, supplied to the hub motors during actual running of the motors to a preset value in the range of 5 to 20 amps, and (c) during the surge-current situation to ramp down the maximal current to the steady-state current over a preset time interval in the range of 1 to 3 seconds.

According to another aspect, methods are provided for propelling and steering a bumper car. An embodiment of such a method comprises providing a bumper car with first and second drive wheels powered by first and second hub wheels, respectively, that are integral with the first and second drive wheels, respectively. Also provided is a source of electrical power carried by the bumper car (i.e., an "internal" source of electrical power). Delivery of electrical power from the source to the first and second hub motors is controlled so as to energize the hub motors in a selective manner serving to propel the bumper car and to perform steering of the bumper car, while: (a) limiting a maximal current supplied by the source to the hub motors, during a surge-current situation, to a preset maximum, and (b) ramping down the maximal current over a preset time interval during the surge-current situation. It also is desirable to control delivery of electrical power from the source to the first and second hub motors in a manner that limits a steady-state current, supplied to the hub motors during actual running of the motors, at a preset value that is lower than the maximal current.

The source of electrical power desirably is provided by at least a first and a second battery that can be selectively used for powering the hub motors, as summarized above.

The foregoing and additional features and advantages of the subject apparatus and methods will be more apparent from the following detailed description, which proceeds with reference to the accompanying drawings.

DETAILED DESCRIPTION

Figure 1:
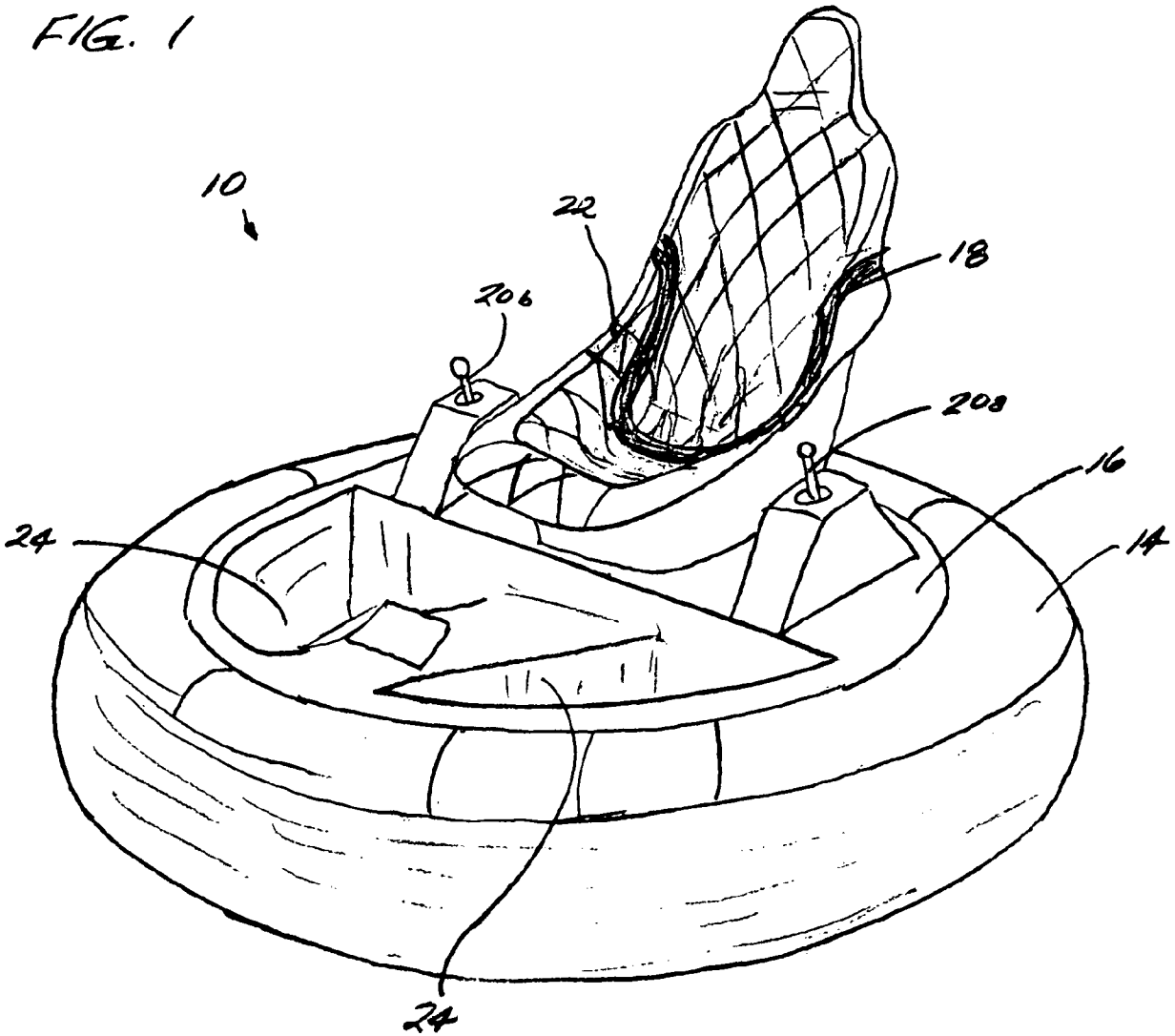
FIG. 1 is a perspective view of the external features of a bumper car according to a representative embodiment.

This disclosure is set forth below in the context of representative embodiments that are not intended to be limiting in any way. Words of relative position, such as "vertical," "horizontal," "above," "below," "over," "under," "front," "rear," and the like are used to facilitate comprehension of structure by using as a frame of reference a bumper car in a normal-use position. However, these terms are not to be construed as imposing any absolute relationships that persist under all conceivable situations.

Bumper cars as described herein are configured to address the following considerations:

First, to provide maximal maneuverability, the bumper cars are provided with two drive wheels, instead of one as in certain conventional bumper cars. The drive wheels desirably are spaced apart from each other on a horizontal axis. The horizontal axis desirably is bisected by a vertical axis passing substantially through a center of gravity of the bumper car and rider. (It is not necessary that the vertical axis intersect the horizontal axis, but these axes desirably are situated such that differential rotation of one drive wheel relative to the other drive wheel provides a desired highly responsive maneuverability of the cars, including 360° turns "on a dime," e.g., about the vertical axis.)

Second, to provide maximal mechanical efficiency, each drive wheel is driven by a respective integral "hub motor." Each hub motor is a combination of an electric motor and a gear train (typically a planetary gear train) in the hub of the respective drive wheel so as to couple the motor directly to the drive wheel. Use of hub motors eliminates the need for external gear trains, transmissions, clutches, chains, belts, and/or other efficiency-robbing mechanical couplings between the motor and respective drive wheel. Thus, each drive wheel is integral with its respective hub motor, yielding a substantially greater mechanical efficiency with which the cars are driven. Such high efficiency correspondingly reduces the power appetite of the bumper car, which is highly desirable in a battery-powered or other internally electrically powered bumper car.

Third, each bumper car is powered by a portable ("internal") source of electrical power, i.e., each bumper car carries its own source of electrical power with it and on it instead of obtaining power from an external source such as an electrified floor. The typical portable supply comprises one or more devices each conventionally (and in a general sense) called a "battery," wherein substantially all known batteries produce direct-current (DC) electrical power. Hence, a "battery" as referred to herein encompasses any of various portable sources of electrical power. In general, the portable source of electrical power is mounted to the frame, either directly or indirectly.

Fourth, delivery of electrical power from the source to the hub motors is controlled using a motor controller that provides, for each hub motor, respective limits on starting/surge current (maximum current draw by the motor when starting, including after a stall), surge time (a defined time period during which current flow up to the surge limit is allowed), and steady-state current (after elapse of the surge time, the maximum current allowed during actual running of the hub motor). Thus, the hub motors are driven only when necessary to achieve a desired motion of the car and are operated under controlled current-draw conditions (including during motor-stall situations) that substantially reduce power consumption and yield a correspondingly longer battery life than exhibited by conventional battery-powered bumper cars.

As noted earlier above, at the moment a voltage is applied to a brushed DC motor that is not turning (e.g., during a stall or at rest, both being conditions in which motional emf of the motor is zero), the motor draws a very large current (a "surge" current) that is limited only by the inductance and resistance of the motor windings. As the motor armature begins to turn and picks up speed, the motional emf increases and opposes the flow of current to the motor, which causes the current to fall rapidly from the surge level toward a steady-state value that depends upon the particular motor and the mechanical load being driven by the motor. The surge current being drawn by a stalled or starting motor, especially under mechanical load, can be very high and can cause rapid heating of the motor. A bumper car under normal-use conditions is subjected to a large number of starts and stops in short periods of time. The battery powering the motor(s) must be able to provide the large number of starts and stops required during normal operation of the bumper car. In addition, these many starts and stops must be provided in a manner that does not cause overheating or other damage to the motor(s). The embodiments described below address these concerns.

Turning first to FIG. 1, general features of a representative embodiment of a bumper car 10 are shown. The bumper car 10 includes a frame 12 (not detailed, but see FIG. 2), a circumferential bumper 14, a molded body 16, a seat 18, and hand controls 20*a*, 20*b* placed so as to be easily reached and manipulated by a rider while seated in the seat. The seat 18 includes a seat belt 22 that restrains the rider in the seat. The body 16 includes depressions 24 that accommodate the rider's lower legs and feet when the rider is seated in the seat 18. The seat belt 22 desirably fits loosely to the rider so that the pivot point of the rider's body is from the rider's seat, not the rider's neck. The depressions 24 position the rider's legs and feet so that the rider's legs can act as stabilizers in a natural manner.

Regarding the frame 12 and body 16, it is possible to integrate the body and frame in a single unit rather than having a separate body that is attached to the frame; such a single unit would still be regarded as a "frame." Also, although in this embodiment the seat is configured to hold one rider, in other embodiments the bumper car can be configured to hold more than one rider. In addition although the seat is depicted in this embodiment as being a separate component that is mounted to the body (or frame), in other embodiments the seat is integral with the body or frame. For example, the body 16 can be molded or formed so as to define a seat. In all these various configurations, the seat nevertheless is "attached" to the frame.

Figure 2:
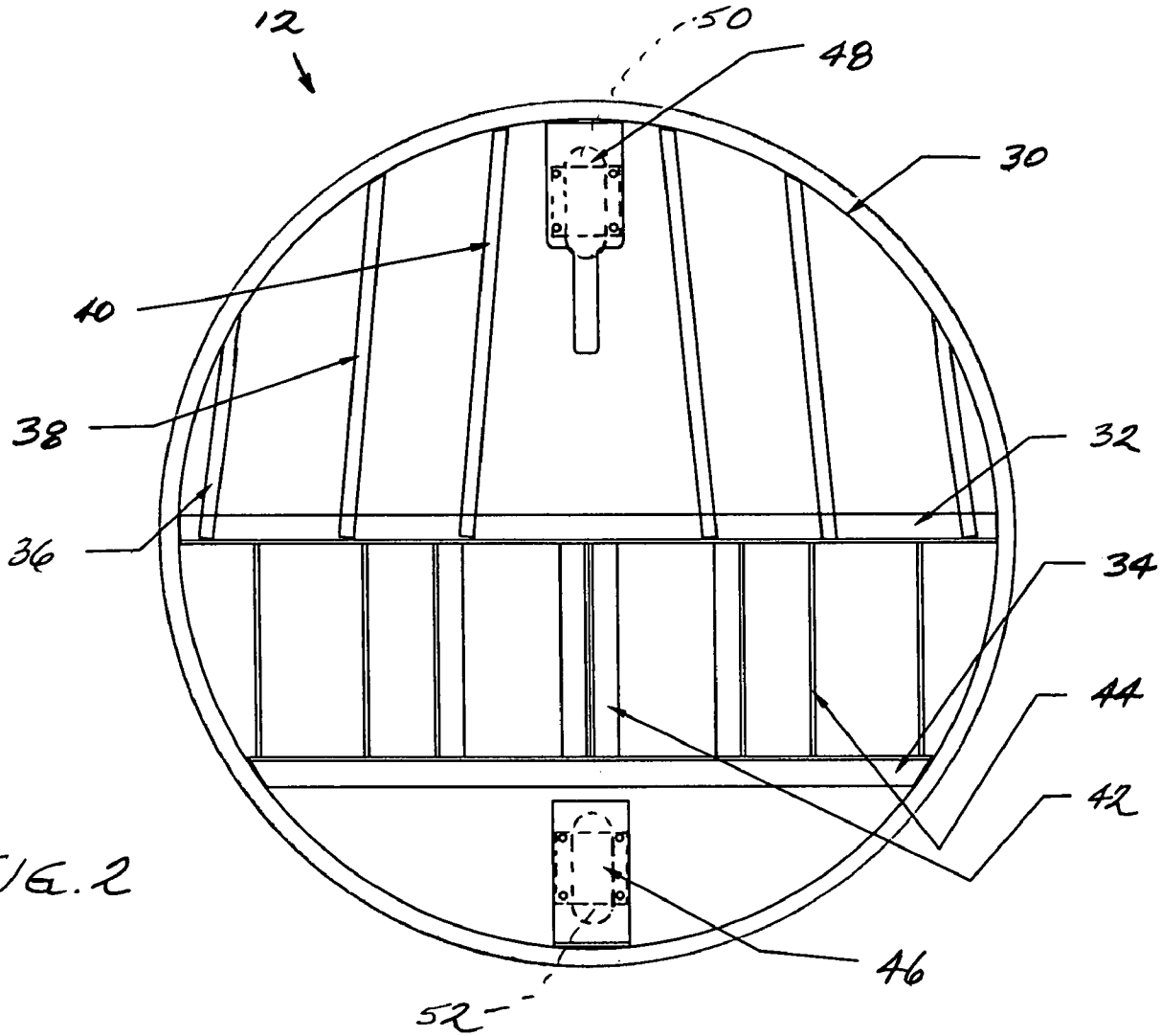
FIG. 2 is a plan view of the frame of the bumper car of FIG. 1.

FIG. 2 is a plan view of the frame 12 with the body and bumper removed. The frame 12 in this embodiment comprises an annular portion 30, a front cross member 32, a rear cross member 34, outside bottom supports 36, middle bottom supports 38, center bottom supports 40, battery-mount members 42, and motor-mount members 44. The frame 12 also comprises a rear caster mount 46 and a front caster mount 48. A respective caster wheel 50, 52 or analogous structure is mounted to the underside of each of the front and rear caster mounts 46, 48, respectively. For durability, the frame 12 desirably is made of mild steel, wherein the various members are welded together and/or connected together by mechanical fasteners. A desirable finish for the frame is a powder-coat finish.

In this embodiment the caster wheels 50, 52 desirably are each swivel-mount and four inches in diameter. It will be understood that other types and sizes of "caster wheels" alternatively could be used.

Figure 3:
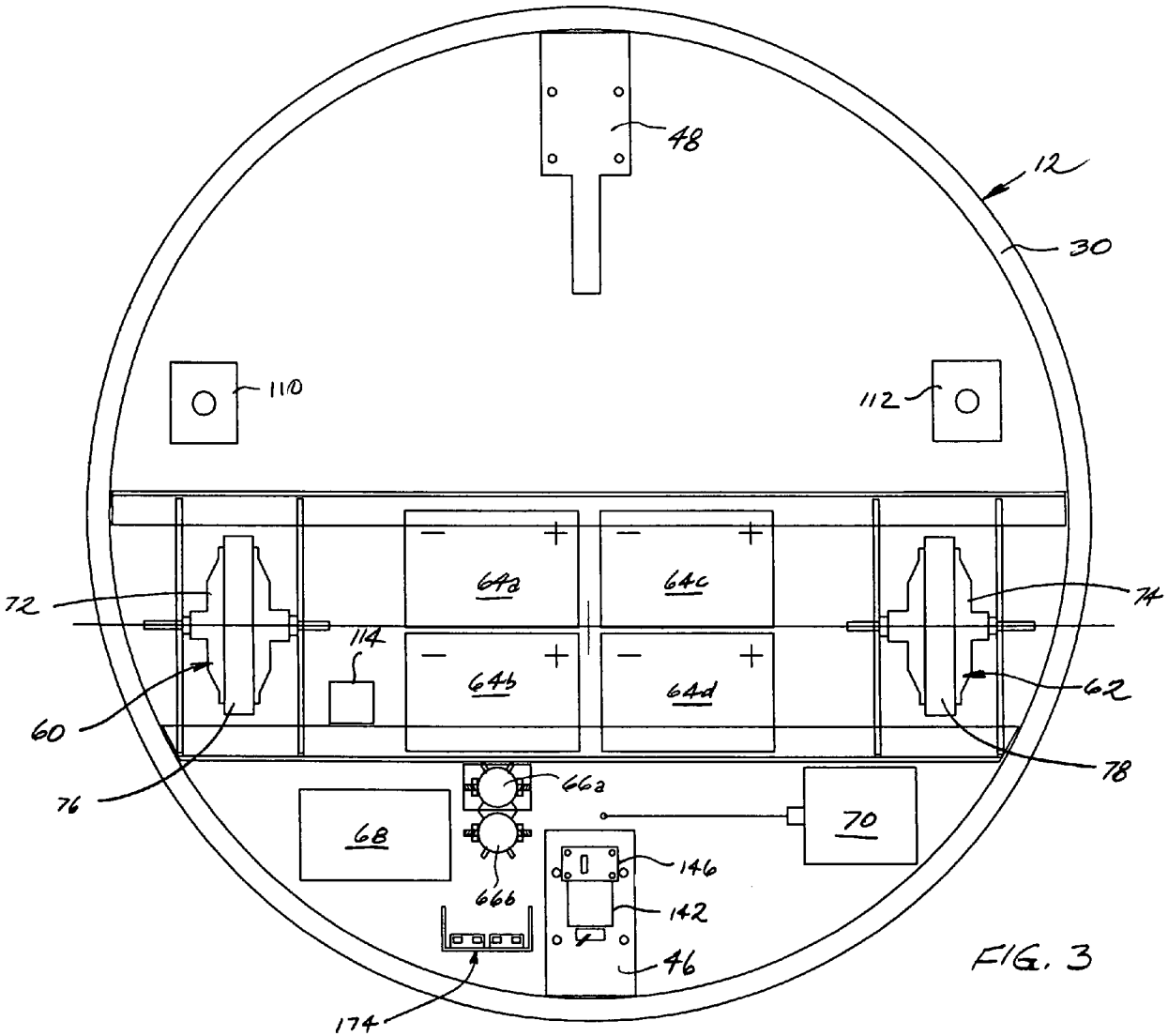
FIG. 3 is a plan view showing certain features of the frame shown in FIG. 2 and also showing batteries, hub motors, controller, and other components mounted to the frame.

FIG. 3 is a plan view showing the frame 12 of FIG. 2 to which are mounted, in this embodiment, first and second drive wheels 60, 62, four sealed batteries 64*a*, 64*b*, 64*c*, 64*d*, two solenoids 66*a*, 66*b*, a motor controller 68, and a radio receiver 70 for receiving on-off signals from a remote radio transmitter (not shown). Other components outlined in FIG. 3 are discussed later below.

Each of the batteries 64*a*-64*d* in this embodiment desirably is a 12 VDC, 32 Amp-hour, sealed type. The four batteries 64*a*-64*d* are connected for alternating use in pairs; i.e., when one pair is "on," the other pair is "off." In FIG. 3 the first pair consists of batteries 64*a*, 64*b*, and the second pair consists of batteries 64*c*, 64*d*. In each pair the batteries are connected together in series, which configures each pair to produce a net 24 VDC output for driving the hub motors in the drive wheels 60, 62. By connecting the batteries 64*a*-64*d* for alternating use in pairs each consisting of multiple batteries, the mass of each battery can be sufficiently low for convenience and ease of handling during maintenance activity, and the bumper car can be operated without running down a particular pair of batteries all the time. It will be understood, however, that use in this embodiment of four batteries in this manner is exemplary, and is not intended to be limiting in any way. Providing direct current from one or more batteries carried about in a bumper car can be achieved in any of various ways, and the particular manner that is selected will reflect prevailing concerns of weight, convenience, and the power requirements of the particular drive wheels.

Each drive wheel 60, 62 comprises a respective hub motor 72, 74 that, in this embodiment, is a brushed 24-volt DC hub motor with an integral brake and integral tire 76, 78. Thus, each drive wheel 60, 62 is integral with its respective hub motor 72, 74. In accordance with achieving intuitive control during driving, the first drive wheel 60 desirably is located on the left side of the frame, and the second drive wheel 62 74 desirably is located on the right side.

An exemplary hub motor is XTi® type 280-1342M manufactured by Assembled Products Corp., Rogers, Ark., which is configured to be driven using 24 VDC. This specific type of hub motor has a solid rubber tire having a diameter of eight inches. The stated diameter is not intended to be limiting. For this particular hub motor, the 8-inch tire diameter was deemed advantageous in view of certain factors such as the maximum rotational velocity (150 rpm) exhibited by this motor when driven at maximal power and a concern with limiting the maximal driving velocity of the car. (An 8-inch diameter drive wheel rotating at 150 rpm provides a car-drive velocity of 3,770 in/min=3.57 ml/hr.) Therefore, depending upon the desired driving velocity of the car, the maximal rotational velocity of the hub motor at full power, and the particular hub motors that are commercially available, an appropriate diameter of the driving wheel can be selected. For example, a hub motor having a lower maximal rotational velocity and a correspondingly larger tire diameter could be used, so long as the motor is able to provide sufficient motive power to the bumper car at an acceptable rate of power consumption. The tire need not be solid; alternatively, it can be pneumatic, for example.

The hub motors 72, 74 also desirably have integral brakes that are actuated whenever power to the motors is interrupted. Thus, the integral brakes operate in a fail-safe mode in which the brakes are off whenever power is being supplied to the motors and the brakes are on whenever power is not being supplied to the motors. This is especially desirable because the brakes, when on, prevent the car from moving while a rider is either exiting or entering the bumper car. Further desirably, the brakes are configured with an override feature (e.g., a manually operated control on each hub motor) to allow the cars to be moved when "off," such as during an emergency situation. Since these types of integral brakes draw a certain amount of power to maintain them in an "off" state whenever the hub motors are "on," the power consumption of the brakes in the hub motors should be taken into consideration in determining the amount of DC power to be provided by the battery or batteries. For example, the brakes on the exemplary hub motors noted above draw about 0.8 amp at 24 VDC.

DC power to the hub motors 72, 74 in this embodiment is supplied by a selected pair of batteries 64*a*-64*b* or 64*c*-64*d* via a respective controller (or via a respective channel of a single controller 68). As noted above, a stalled motor normally draws maximal current until power to the motor is disconnected. This situation could have serious power-dissipation consequences for a semiconductor-based controller being used to control the motor. The controller 68 desirably is semiconductor-based but is configured to control each bi-directional load (i.e., each respective hub motor that can move in forward and reverse directions) while simultaneously limiting the following parameters for each load: starting/surge current, steady-state current, and surge time. By imposing these limitations, both the controller 68 and the motors 72, 74 escape the hazards of surge currents.

For this particular bumper-car embodiment, exemplary levels for the controller parameters are as follows (at 24 VDC): starting/surge current: 25 amps, steady-state current: 10 amps, and surge time: 2 seconds to drop from 25 to 10 amps. Representative ranges for a car sized to carry an adult rider are 25-30 amps for starting/surge current (approximately 15 amps for a smaller car for small-child riders), 5-20 amps for steady-state, and 1-3 seconds surge time. If a surge-current or otherwise high-current situation is detected by the controller 68, the controller reduces, over a preset amount of time, the power delivered to the respective load. Thus, maximal current supplied to the hub motors during a surge-current situation is: (a) limited to a preset maximum appropriate for the particular hub motors, and (b) automatically ramped down, rather than abruptly shut off, over a preset time interval during the surge-current situation. (The longer the time interval, the more time consumed in reducing the current from a surge level to the steady-state level.) Also, steady-state current supplied to the hub motors during actual running of the motors is limited to a preset value that is lower than the surge maximum.

Example types of controllers offering such performance are triac-based controllers, chopper-based controllers, and full-bridge-based controllers. In the case of a triac-based controller, a respective triac can be used to control each motor, or a respective triac can be used to control each rotational direction of each motor. Each triac can be controlled using, for example, a control IC (integrated circuit) or a microcontroller. Many chopper circuits utilize chopper MOSFETs that control the rate and duration of application of current to the motor. This type of circuit can incorporate a "soft-start" feature, in which the motor is set in motion over a period of time, rather than instantly, by application of periodic bursts of current to the motor, and surge currents are avoided by initially allowing the chopper MOSFET to conduct for only short periods of time. The full-bridge-based controller circuit achieves forward, reverse, and braking control of the motor, typically using four MOSFETs that are controlled using a microcontroller. The MOSFETs apply packets of current to the motor in a manner by which the frequency and duration of the packets are controlled by the microcontroller.

Figure 4:
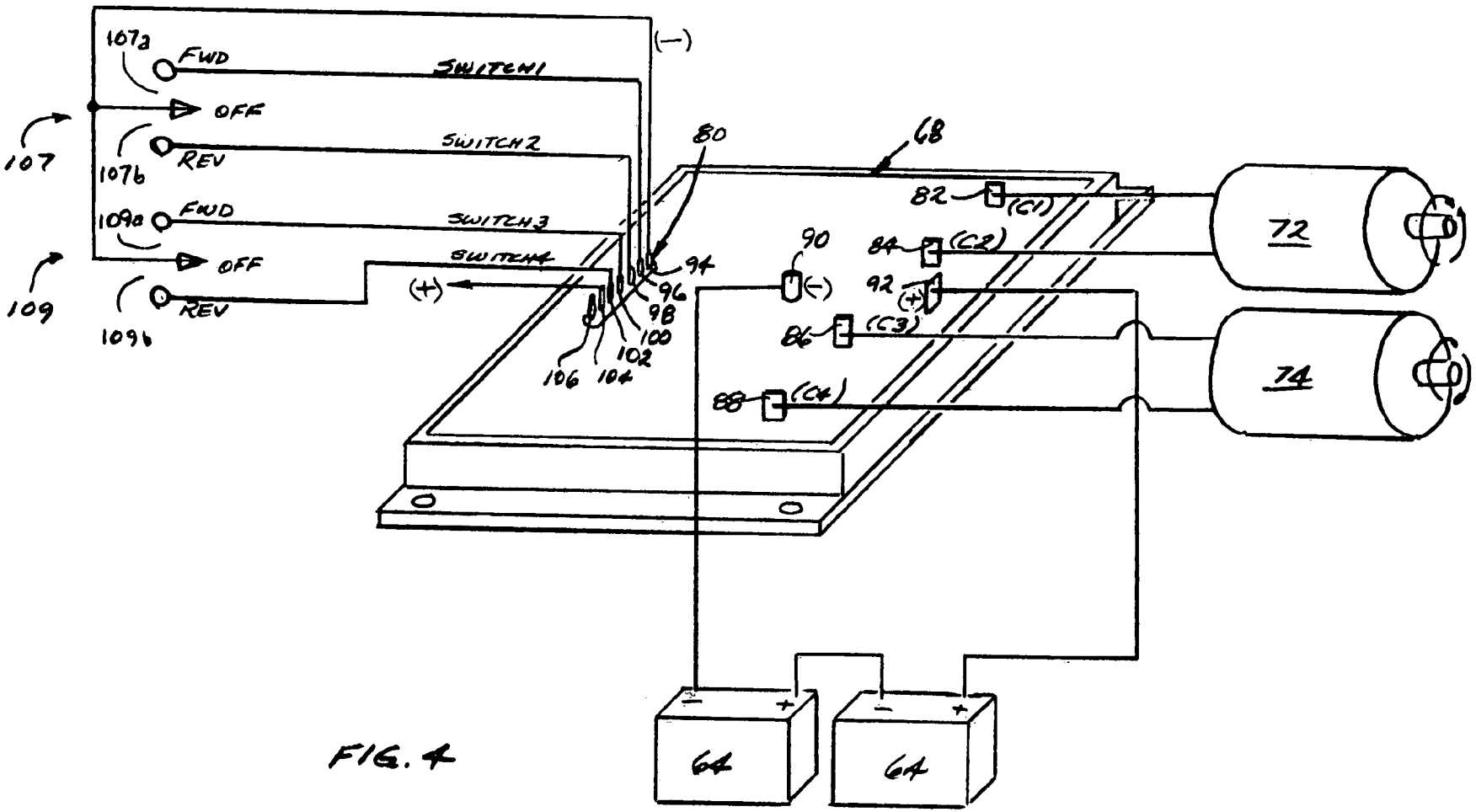
FIG. 4 is a perspective view showing the manner in which the hub motors and batteries are connected to a particular type of controller. The figure also depicts an exemplary manner in which active-low control switches can be connected to the controller for controlling operation of the hub motors.

An exemplary controller 68 is the "Dual30" two-channel controller manufactured by Courtney Electronics, Greenland, Ark. This particular controller can independently control two hub motors 72, 74, connected as shown in FIG. 4, and allows the current limits and surge times to be programmed into the controller using a computer. The controller 68 has a seven-pin connector 80 as well as high-current lugs 82, 84 ("C1" and "C2") for connecting to the first motor 72 and high-current lugs 86, 88 ("C3" and "C4") for connecting to the second motor 74. The controller 68 also has high-current lugs 90, 92 for receiving power from the batteries 64. In the seven-pin connector 80, the first pin 94 is ground, the second pin 96 is "WIPER1" (analog 0-5 VDC)/SWITCH1 (active-low digital), the third pin 98 is "WIPER2" (analog 0-5 VDC)/SWITCH2 (active-low digital), the fourth pin 100 is SWITCH3 (active-low digital), the fifth pin 102 is SWITCH4/INH (active-low digital), the sixth pin 104 is $V_k$ (programming supply voltage), and the seventh pin 106 is $V_{dd}$ (logic voltage +5 VDC). The INH pin (fifth pin 102) can be used to inhibit output to both channels simultaneously. To inhibit all outputs ("inhibit" mode), a connection is made from the INH pin 102 to logic ground (first pin 94). Opening this connection will cause the controller 68 to exit the inhibit mode.

In general, the controller 68 can be used with any of various input schemes, such as a joystick-based input scheme, a dual-potentiometer input scheme, or an active-low switch input scheme. An active-low switch input scheme is shown in FIG. 4, in which two double-throw switches 107, 109 are used, one for each motor 72, 74, respectively. The switch 107 effectively comprises two single-throw switches 107*a*, 107*b*, and the switch 109 effectively comprises two single-throw switches 109*a*, 109*b*. In this scheme, "C1," "C2," "C3," and "C4" are controlled by active-low inputs SWITCH1 (second pin 96), SWITCH2 (third pin 98), SWITCH3 (fourth pin 100), and SWITCH4 (fifth pin 102), respectively. SWITCH1 and SWITCH2 correspond to switches 107*a* and 107*b*, respectively, and SWITCH3 and SWITCH4 correspond to switches 109*a* and 109*b*, respectively. To "activate" any given input, a connection is made from the corresponding input pin to logic ground (GND, first pin 94). If both inputs corresponding to a particular motor are driven low (e.g., SWITCH1 and SWITCH2 for the first motor 72), a switch fault is detected, and the output to that motor is inhibited.

Figure 5A:
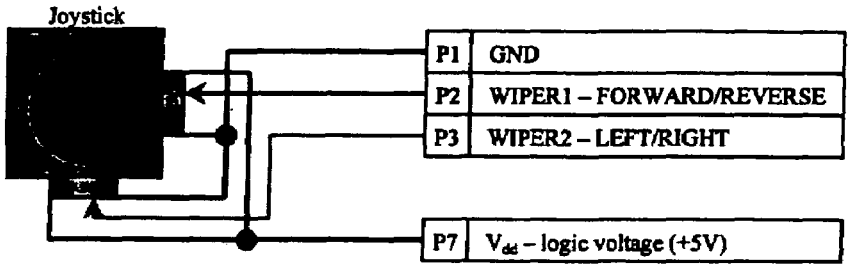
FIG. 5(A) provides certain details of the manner in which a joystick can be connected to the controller for controlling operation of the hub motors. Normally, two joysticks would be connected, one for each respective hub motor. Also shown are throttle zones associated with the joystick.
Figure 5A:
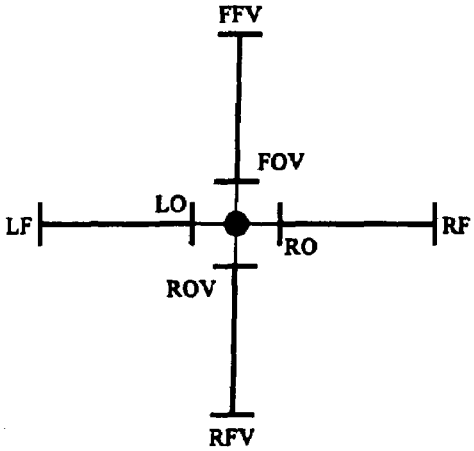

For this particular bumper-car embodiment, a joystick-based input scheme is desirable because it provides directional and speed controls in a manner that is familiar to most riders. For example, any joystick that produces two analog outputs may be used so long as the controller 68 is properly programmed. An exemplary joystick connection for the first motor 72 is shown in FIG. 5(A), in which "P1" is the first pin 94, "P2" is the second pin 96, "P3" is the third pin 98, and "P7" is the seventh pin 106 of the connector 80. This figure also depicts the available throttle zones of the joystick. In one embodiment, an exemplary joystick (two per car) is model 50-7604-10, manufactured by Happ Controls, Elk Grove, Ill. This type of joystick has respective connecting pins that are denoted "common," "normally open," and "normally closed." The common and normally open pins are used, as discussed later with respect to FIG. 6.

Figure 5B:
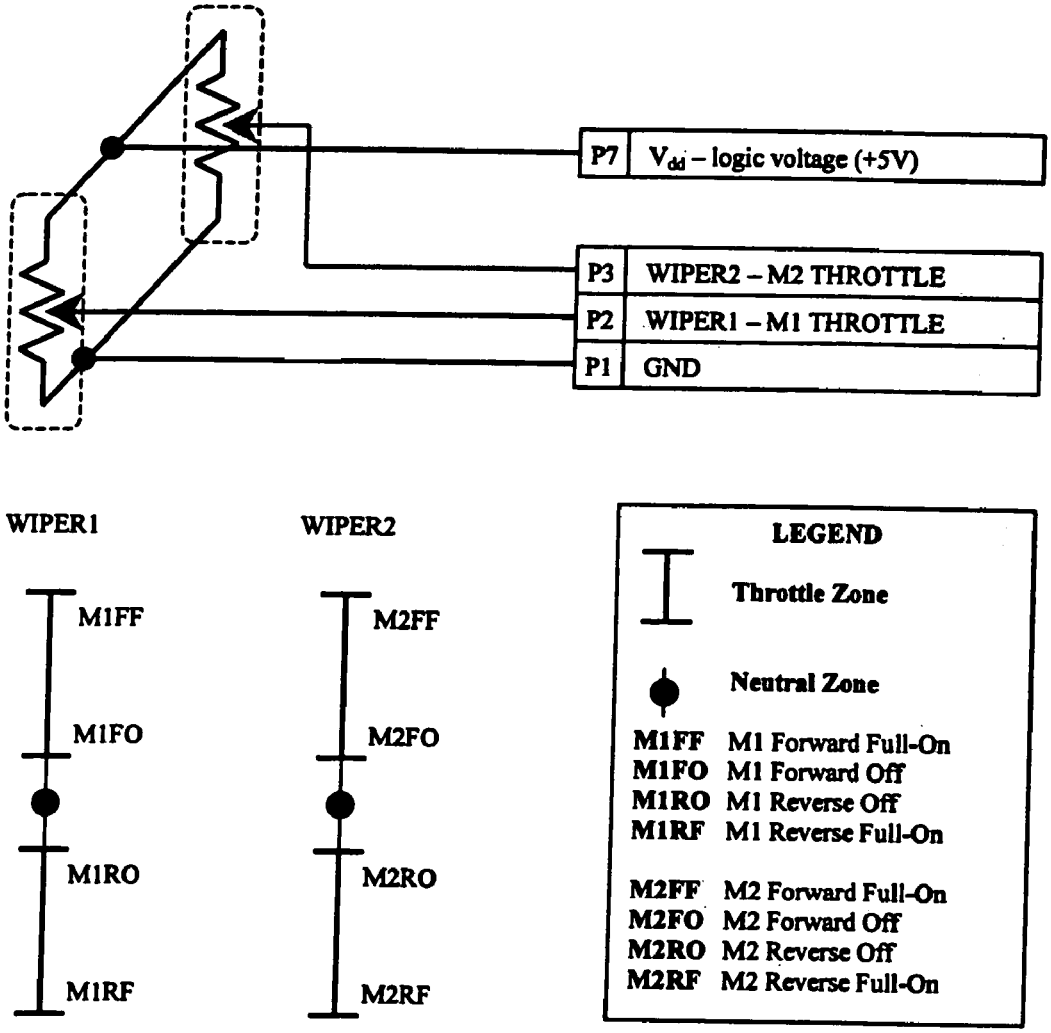
FIG. 5(B) provides certain details of the manner in which dual potentiometers can be connected to the controller for controlling operation of the hub motors. Also shown are throttle zones associated with the dual potentiometers.

An exemplary dual-potentiometer input scheme is shown in FIG. 5(B), which also depicts the available throttle zones. In this mode, each motor 72, 74 is controlled by a respective center-off variable analog input. WIPER1 (second pin 96) and WIPER2 (third pin 98) are the throttle inputs for the first motor 72 and second motor 74, respectively. This throttle option provides control of direction as well as speed.

Figure 6:
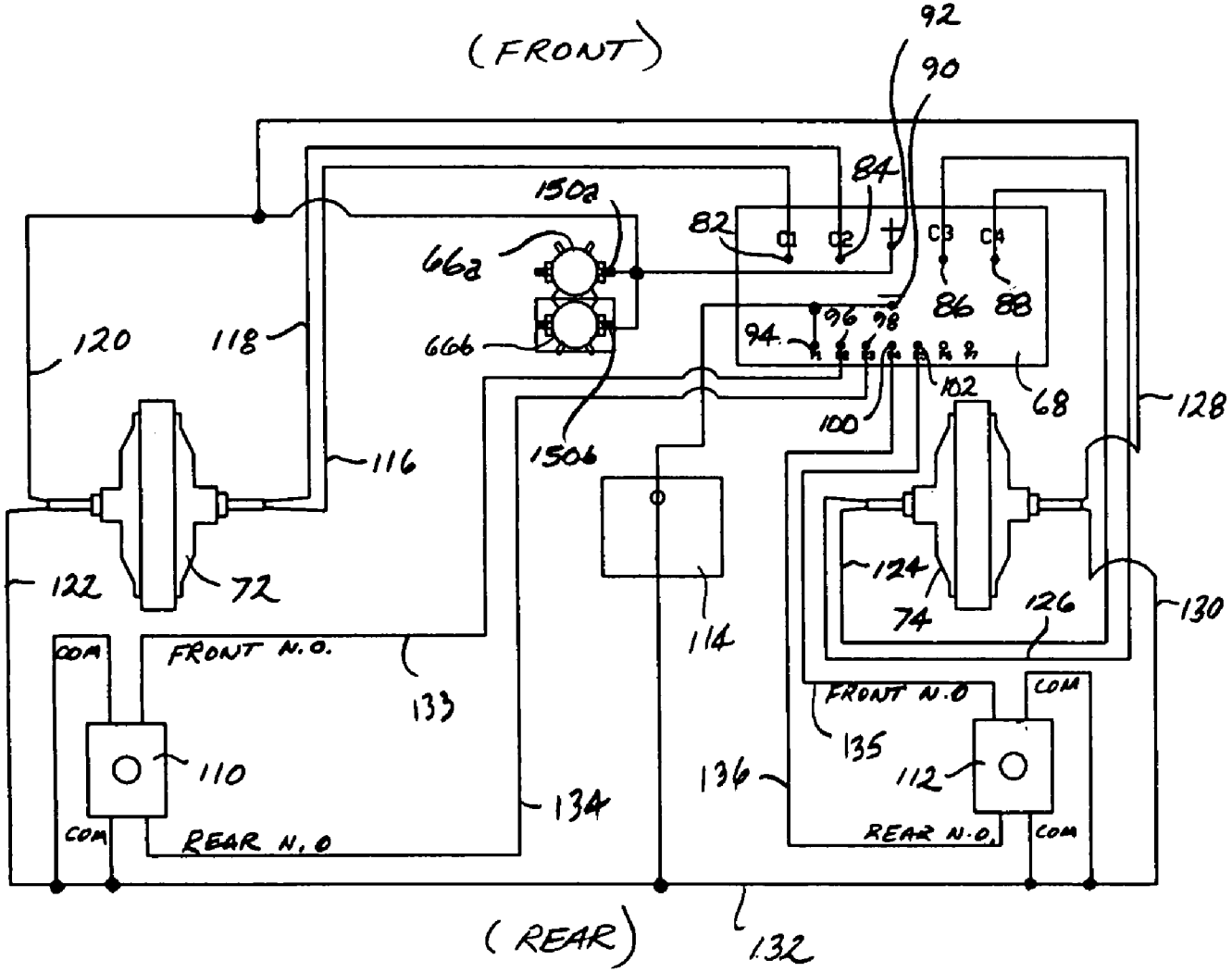
FIG. 6 is an electrical schematic wiring diagram, showing connections of the hub motors and joysticks to the controller.

An electrical schematic of an embodiment of a circuit by which joysticks 110, 112, the controller 68, and the hub motors 72, 74 are interconnected is provided in FIG. 6. Also shown are a ground block 114, the first solenoid 66*a*, and the second solenoid 66*b*. The first motor 72 has a red-insulated lead 116 and a black-insulated lead 118 for forward and reverse operation, respectively, a positive-power lead 120, and a negative-power lead 122. Similarly, the second motor 74 has a red-insulated lead 124 and a black-insulated lead 126 for forward and reverse operation, respectively, a positive-power lead 128, and a negative-power lead 130. On the controller, the "C1" lug 82 is connected to the red-insulated lead 116 of the first motor 72, the "C4" lug 88 is connected to the red-insulated lead 124 of the second motor 74, the "C2" lug 84 is connected to the black-insulated lead 118 of the first motor 72, and the "C3" lug 86 is connected to the black-insulated lead 126 of the second motor. (For joystick operation, "C1" is the FORWARD output lug for the first motor 72, "C2" is the REVERSE output lug for the first motor, "C3" is the FORWARD output lug for the second motor 74, and "C4" is the REVERSE output lug for the second motor.) Further with respect to the controller 68, the "−" power lug 90 is connected to the first pin 94 and to the ground block 114, and the "+" power lug 92 is connected to outputs of the first and second solenoids 66*a*, 66*b*. The "+" power lug 92 also is connected via lead 120 to the first motor 72 and via lead 128 to the second motor 74. The ground block 114 is also connected, via a ground conductor 132, to the first joystick 110, to the second joystick 112, to the first motor 72 via lead 122, and to the second motor 74 via lead 130.

On the first (left-hand) joystick 110, the two "common" (COM) terminals are connected to the ground conductor 132, the front normally open (N.O.) terminal is connected via a conductor 133 to pin 96 (P2) on the controller 68, and the rear N.O. terminal is connected via a conductor 134 to pin 98 (P3) on the controller. Similarly, on the second (right-hand) joystick 112, the two COM terminals are connected to the ground conductor 132, the front N.O. terminal is connected via a conductor 135 to pin 102 (P5) on the controller 68, and the rear N.O. terminal is connected via a conductor 136 to pin 100 (P4) on the controller. As noted above, the normally closed (N.C.) terminals on the joysticks 110, 112 are not used in this embodiment.

Figure 7:
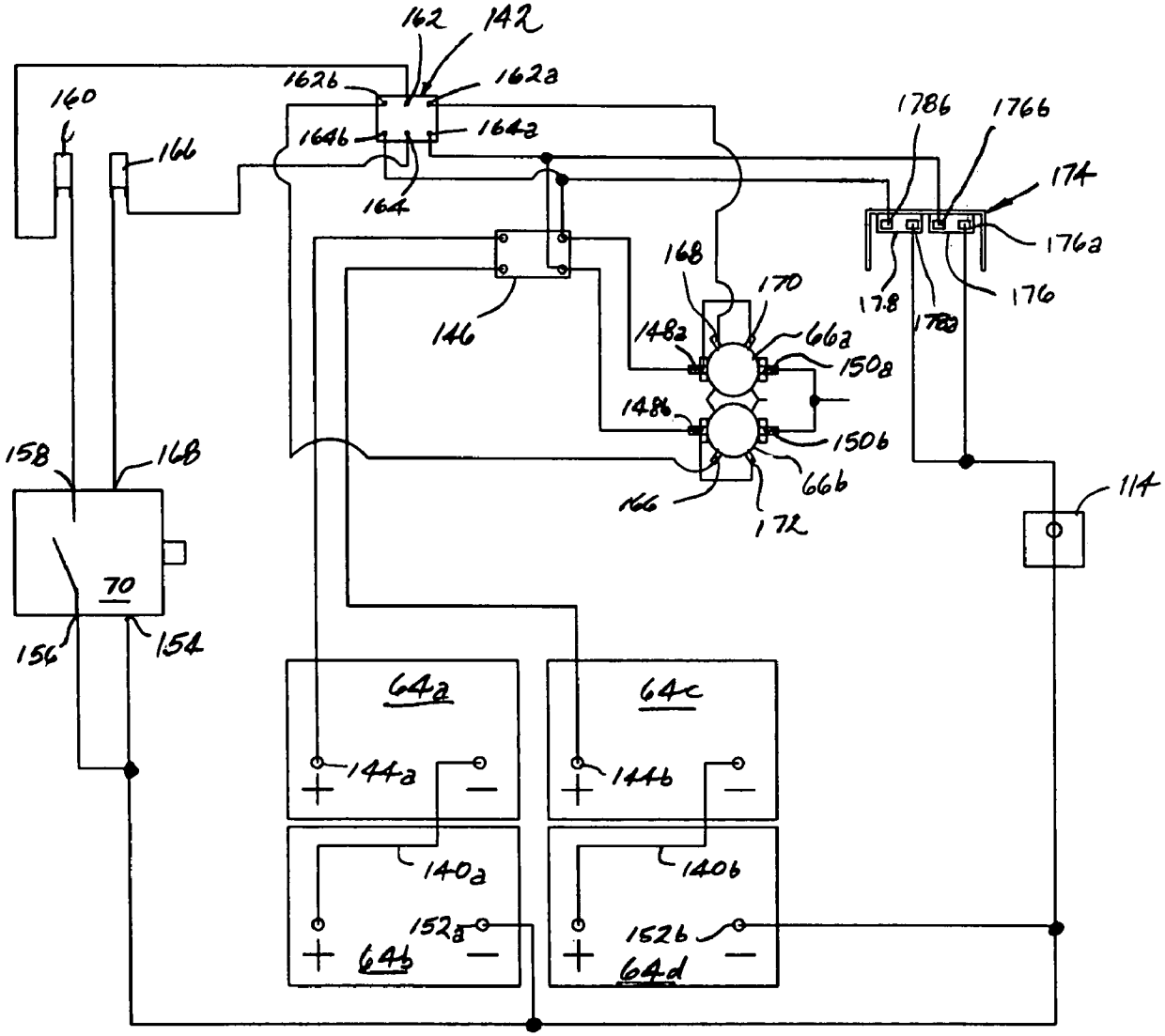
FIG. 7 is an electrical schematic wiring diagram that is essentially a continuation of FIG. 6, showing interconnections of the batteries, radio receiver, and solenoids.

An electrical schematic of the wiring of the batteries 64*a*-64*d* and associated electrical components is shown in FIG. 7, which is basically a continuation of FIG. 6. As noted earlier above, in this embodiment four batteries 64*a*, 64*b*, 64*c*, 64*d* are used. The batteries are arranged in two pairs, the first pair consisting of batteries 64*a* and 64*b*, the second pair consisting of batteries 64*c* and 64*d*. In each pair, the respective batteries are connected in series by a respective conductor 140*a*, 140*b* (to produce a net 24 VDC output from each pair). The pairs of batteries are individually selectable for use, by manipulating a battery-selector switch 142, in powering the bumper car. Thus, during normal-use conditions in a commercial setting, such as at the beginning of a day in which a ride operator makes the cars available for rides by paying riders, the bumper cars consume power from one pair of batteries during, say, the morning hours, and power from the other pair of batteries during the afternoon hours. Recharging of the batteries can be conducted after-hours.

As noted above, in alternative embodiments, two batteries can be used, wherein each battery is used in place of a respective pair of batteries used in the depicted embodiment. Yet further embodiments can employ only a single battery. Also, the battery or batteries are not limited to 12 or 24 VDC output. Other voltage outputs can be used as appropriate for the particular bumper car (and hub motors of the car), the conditions under which the car will be used, and the prevailing level of battery technology. Changing the battery voltage likely will necessitate a change in the specifications of the hub motors 72, 74; however, such a change is readily accommodated in view of the various types of hub motors that currently are commercially available.

Referring further to FIG. 7, the respective "+" power terminals 144*a*, 144*b* of the pairs of batteries are connected to respective input lugs of a main fuse block 146. Positive voltage passing through the main fuse block 146 is supplied to respective power-input lugs 148*a*, 148*b* of the starter solenoids 66*a*, 66*b*, which have respective power-output lugs 150*a*, 150*b* connected together (see also FIG. 6) to deliver "+" power to the controller 68 and hence to the motors 72, 74. The "−" power terminals 152*a*, 152*b* of each pair of batteries are connected in parallel to the ground block 114 and to the radio receiver 70 (specifically to a "−" power input 154 and a switch input 156). A switch output 158 of the radio receiver 70 is connected via a first circuit breaker 160 to a first pole 162 of the battery-selector switch 142. A second pole 164 of the battery-selector switch 142 is connected via a second circuit breaker 166 to a "+" power input 168 of the radio receiver 70. Thus, the radio receiver 70 receives "+" and "−" operating power from the batteries via the power inputs 154, 168.

The radio receiver 70 functions as a radio-actuated switch. Whenever the radio receiver 70 receives a respective signal from a remote radio transmitter (not shown), the radio receiver opens or closes an internal switch that breaks or makes, respectively, an electrical connection between the switch input 156 and the switch output 158. Thus the bumper car (as well as other cars in the vicinity, if desired) can be turned on and off remotely (and simultaneously, if desired). Desirably, in the manner of a "fail safe" configuration, the radio receiver 70 opens its internal switch (thereby turning power to the car off) in a situation in which power delivery to the radio receiver is off. If desired, the car can be provided with a bypass switch (not shown, but desirably manually operated) that overrides the radio receiver.

Further with respect to the battery-selector switch 142, a pin 162*a* is connected to a "−" coil input 166 of the second solenoid 66*b*, and a pin 162*a* is connected to a "−" coil input of the first solenoid 66*a*. The first solenoid 66*a* receives "+" coil power via a "+" coil input 170 that is connected to the power-input lug 148*a*. Similarly, the second solenoid 66*b* receives "+" coil power via a "+" coil input 172 that is connected to the power-input lug 148*b*. Thus, the respective coils of the solenoids 66*a*, 66*b* receive constant "+" power from the main fuse block 146 but switched "−" power from the battery-selector switch 142. Furthermore, via the second pole 164, the radio receiver 70 always receives "+" power, supplied by either the pin 164*a* or the pin 164*b* of the battery-selector switch 142. Thus, the battery-selector switch 142 is a DPDT switch providing selective control of the particular pair of batteries being used for powering the car, without interrupting power to the radio receiver 70.

The batteries are recharged by connection of a conventional recharging unit (not shown) to a charging-plug assembly 174. The recharging-plug assembly 174 comprises two plugs 176, 178. Each plug 176, 178 has a respective first pin 176*a*, 178*a* connected to "−" battery power via the ground block 114 as shown, and a respective second pin 176*b*, 178*b* connected to "+" battery power via the main fuse block 146 as shown. Application of charging power to the plug 176 recharges the pair of batteries 64*c*, 64*d*, and application of charging power to the plug 178 recharges the batteries 64*a*, 64*b*.

Testing under normal actual-use conditions has revealed that bumper cars within the scope of the instant disclosure, configured according to the representative embodiment, and having new batteries with a full charge operating under normal-use circumstances, will provide approximately 100 ride cycles (each being 2 minutes in duration, with an approximately 30-second pause between each cycle to allow exchange of riders) per pair of batteries. Thus, the four batteries 64*a*-64*d* can supply adequate power to the bumper car for approximately 200 2-minute ride cycles per full battery charge. This is two to six times the usable life, per charge, of conventional battery-powered bumper cars.

Internally powered bumper cars as described herein offer substantial latitude in terms of locations and conditions of use of the cars. For example, internal power allows the bumper cars to be used on various surfaces not limited to conductive floors and the like. That said, it is nevertheless is possible for bumper cars having hub motors as described herein to obtain power from a conductive floor or analogous means. Another advantage of internal power such as a battery pack is that the delivered power is substantially free of potentially harmful voltage fluctuations, spikes, and the like. If the cars are powered externally, such as via a conductive floor, desirably either the bumper cars include circuitry for filtering the delivered power or the external power supply itself (i.e., supplying power to the floor) is filtered sufficiently for use by the motor controller.

Whereas the subject bumper cars and other aspects have been described above in the context of representative embodiments, the invention is not limited to those embodiments. On the contrary, the subject bumper cars and other aspects are intended to cover all alternatives, modifications, and equivalents as may be included within the spirit and scope of the invention, as defined by the appended claims.

What is claimed is:

1. A bumper car, comprising:

a frame;

a seat attached to the frame, the seat being configured to hold and position at least one rider of the bumper car;

a portable source, mounted to the frame, of electrical power for propelling the bumper car;

multiple drive wheels mounted to the frame, each drive wheel comprising a respective hub motor that, when supplied with the electrical power from the source, rotates the respective drive wheel relative to the frame and propels the bumper car, each hub motor being a combination of an electric motor and one or more gears located in a hub of the respective drive wheel;

a motor controller connected to the source and to the hub motors, the motor controller being configured (a) to limit a maximal current, supplied by the source to the hub motors during a surge-current situation, to a preset maximum, and (b) to ramp down the maximal current, over a preset time interval, during the surge-current situation; and at least one rider control interconnected with the source, the hub motors, and the motor controller and configured to be manipulated by a rider for propelling and maneuvering the bumper car.

2. The bumper car of claim 1, wherein the motor controller is further configured to limit a steady-state current, supplied to the hub motors during actual running of the motors, to a preset value that is lower than the maximal current.

3. The bumper car of claim 1, further comprising a bumper mounted to and extending substantially circumferentially around the frame.

4. The bumper car of claim 1, wherein the source of electrical power comprises at least one battery.

5. The bumper car of claim 4, wherein the source of electrical power comprises multiple batteries.

6. The bumper car of claim 5, wherein the multiple batteries are arranged in pairs, each pair being connected so as to provide, in a selectable individual manner, electrical power to the hub motors, such that, when one pair is supplying the electrical power to the hub motors, the other pair is not supplying the electrical power to the hub motors, and vice versa.

7. The bumper car of claim 5, wherein the multiple batteries are arranged into a first battery set and a second battery set, the sets being connected so as to provide, in a selectable individual manner, electrical power to the hub motors, such that, when the first battery set is supplying the electrical power to the hub motors, the second battery set is not supplying the electrical power to the hub motors, and vice versa.

8. The bumper car of claim 7, wherein:

the first battery set comprises two respective batteries; and the second battery set comprises two respective batteries.

9. The bumper car of claim 8, wherein, in each battery set, the respective batteries are connected together in series.

10. The bumper car of claim 7, further comprising a battery-selector switch interconnected with the battery sets, the battery-selector switch having a first selectable position allowing electrical power to be drawn from the first battery set to the hub motors, and a second selectable position allowing electrical power to be drawn from the second battery set to the hub motors.

11. The bumper car of claim 1, wherein the at least one rider control comprises a respective joystick.

12. The bumper car of claim 11, wherein:

the multiple drive wheels comprise a left drive wheel and a right drive wheel;

the at least one rider control comprises a first joystick and a second joystick; and the first joystick is connected so as to control operation of the left drive wheel, and the second joystick is connected so as to control operation of the right drive wheel.

13. The bumper car of claim 12, wherein:

the first joystick is an analog joystick with a throttle zone and is situated to be manipulated by a left hand of the rider; and the second joystick is an analog joystick with a throttle zone and is situated to be manipulated by a right hand of the rider independently of the first joystick; and the speed at which one of the respective drive wheels rotates depends upon the position of one of the analog joysticks in a respective throttle zone.

14. The bumper car of claim 1, wherein:

the source produces 24 VDC electrical power;

the respective hub motors are configured to run on the 24 VDC for rotating the respective drive wheels; and the motor controller is configured (a) to limit the maximal current supplied to the hub motors during a surge-current situation to a preset maximum in a range of 25 to 30 amps, (b) to limit the steady-state current, supplied to the hub motors during actual running of the motors to a preset value in a range of 5 to 20 amps, and (c) during the surge-current situation to ramp down the maximal current to the steady-state current over a preset time interval in a range of 1 to 3 seconds.

15. A bumper car, comprising:

a frame;

a seat attached to the frame, the seat being configured to hold and position at least one rider of the bumper car;

a portable source, mounted to the frame, of electrical power for propelling the bumper car;

multiple drive wheels mounted to the frame, each drive wheel comprising a respective hub motor that, when supplied with the electrical power from the source, rotates the respective drive wheel relative to the frame and propels the bumper car, each hub motor being a combination of an electric motor and one or more gear means located in a hub of the respective drive wheel;

a motor controller connected to the source and to the hub motors, the motor controller being configured to perform at least two of (a) limiting a maximal current, supplied by the source to the hub motors during a surge-current situation, to a preset maximum, (b) ramping down the maximal current, over a preset time interval, during the surge-current situation, and (c) limiting a steady-state current, supplied to the hub motors during actual running of the motors, to a preset value that is lower than the maximal current; and at least one rider control interconnected with the source, the hub motors, and the motor controller and configured to be manipulated by a rider for propelling and maneuvering the bumper car.

16. A bumper car, comprising:

frame means for holding and supporting components of the bumper car;

seat means for holding and positioning a rider while riding in and maneuvering the bumper car;

portable power means, supported by said frame means, for supplying electrical power;

drive-wheel means for propelling the bumper car, the drive-wheel means comprising hub-motor means for actuating, when said hub-motor means are supplied with electrical power from said portable power means, said drive-wheel means to propel the bumper car, each hub-motor means being a combination of electric motor means and gear means located in a hub of the respective drive-wheel means;

motor-controller means for controlling the supplying of electrical power from said portable power means to said hub-motor means while (a) limiting a maximal current, supplied by said portable power means to said hub-motor means, during a surge-current situation to a preset maximum, and (b) ramping down the maximal current, over a preset time interval, during the surge-current situation; and control means, manipulatable by the rider, for supplying electrical power to said hub-motor means to propel the bumper car and to maneuver the bumper car.

17. The bumper car of claim 16, wherein said motor-controller means controls the supplying of electrical power to said hub-motor means further while limiting a steady-state current, supplied to said hub-motor means, to a preset value that is lower than the maximal current.

18. The bumper car of claim 16, wherein said portable power means comprises battery means.

19. The bumper car of claim 16, further comprising bumper means for cushioning impact of the bumper car with other objects.

20. The bumper car of claim 19, wherein said portable power means comprises battery means.

21. The bumper car of claim 20, wherein said battery means comprises multiple batteries, the bumper car further comprising selector means for selecting a particular one or more batteries for use in propelling the bumper car.

22. The bumper car of claim 16, wherein said control means comprises at least one joystick means.

23. The bumper car of claim 16, wherein:

said drive-wheel means comprises first and second drive wheels; and said hub-motor means comprises first and second hub motors associated with the first and second drive wheels, respectively;

wherein said motor-controller means is for controlling the supplying of electrical power from said portable power means to the first and second hub-motors.

24. A method for propelling a bumper car, comprising:

providing a bumper car with first and second drive wheels powered by first and second hub motors, respectively, that are integral with the first and second drive wheels, respectively, each hub motor being a combination of an electric motor and one or more gears located in a hub of the respective drive wheel;

providing a source of electrical power carried by the bumper car; and controlling delivery of electrical power from the source to the first and second hub motors so as to energize the hub motors in a selective manner serving to propel the bumper car, while (a) limiting a maximal current supplied by the source to the hub motors, during a surge-current situation, to a preset maximum, and (b) ramping down the maximal current over a preset time interval during the surge-current situation.

25. The method of claim 24, wherein the source of electrical power is provided by at least a first and a second battery.

26. The method of claim 24, wherein controlling delivery of electrical power from the source to the first and second hub motors further comprises limiting a steady-state current, supplied to the hub motors during actual running of the motors, at a preset value that is lower than the maximal current.

27. The method of claim 24, further comprising steering the bumper car while propelling the bumper car.

28. The method of claim 27, wherein steering is performed by controlling respective amounts of electrical current delivered to the first and second hub motors so as to produce corresponding rotational velocities of the first and second drive wheels.

29. A method for propelling and maneuvering a bumper car, comprising:

providing a bumper car with first and second drive wheels powered by first and second hub motors, respectively, that are integral with the first and second drive wheels, respectively, each hub motor being a combination of an electric motor and one or more gears located in a hub of the respective drive wheel;

providing a source of electrical power carried by the bumper car;

controlling delivery of electrical power from the source to the first and second hub motors so as to energize the hub motors in a selective manner serving to propel the bumper car, the delivery control including at least two of (a) limiting a maximal current supplied by the source to the hub motors, during a surge-current situation, to a preset maximum, (b) ramping down the maximal current over a preset time interval during the surge-current situation, and (c) limiting a steady-state current, supplied to the hub motors during actual running of the motors, at a preset value that is lower than the maximal current; and steering the bumper car by controlling respective amounts of electrical current delivered to the first and second hub motors so as to produce corresponding rotational velocities of the first and second drive wheels.

* * * * *

UNITED STATES PATENT AND TRADEMARK OFFICE

CERTIFICATE OF CORRECTION

PATENT NO. : 7,607,500 B2
APPLICATION NO. : 11/372398
DATED : October 27, 2009
INVENTOR(S) : Sweringen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 701 days.

Signed and Sealed this

Twelfth Day of October, 2010

David J. Kappos

David J. Kappos
*Director of the United States Patent and Trademark Office*